US005626539A

United States Patent [19]

Piaget et al.

[11] Patent Number: 5,626,539

[45] Date of Patent: May 6, 1997

[54] TREADMILL APPARATUS WITH DUAL SPRING-LOADED TREADS

[76] Inventors: Gary D. Piaget, 3390 American Saddler Dr.; Trace O. Gordon, 3880 W. Lariat Rd., both of Park City, Utah 84060

[21] Appl. No.: 589,120

[22] Filed: Jan. 19, 1996

[51] Int. Cl.[6] ..... A63B 22/02

[52] U.S. Cl. ..... 482/54; 482/52

[58] Field of Search ..... 482/51, 52, 54, 482/53

[56] References Cited

U.S. PATENT DOCUMENTS

| | | | |
|---|---|---|---|
| 4,204,673 | 5/1980 | Speer, Sr. . | |
| 4,938,473 | 7/1990 | Lee et al. . | |
| 5,114,388 | 5/1992 | Trulaske . | |
| 5,183,448 | 2/1993 | Wang | 482/52 |
| 5,336,146 | 8/1994 | Piaget et al. . | |

*Primary Examiner*—Lynne A. Reichard
*Attorney, Agent, or Firm*—Salter & Michaelson

[57] ABSTRACT

A treadmill device includes a frame, and two independent side-by-side treadmills each having a continuous tread and first and second ends. The device further includes link members for supporting the first and second end of the treadmills above the frame. Each of the link members has a first end pivotably connected to the frame and a second end pivotably connected to the respective treadmill adjacent the respective end thereof. The device still further includes first and second spring-return hydraulic cylinder assemblies for independently supporting the respective treadmills in a first elevated position above the frame, and for independently resisting downward movement of the treadmills from the first position to a second position. The treads may be driven by a mechanical drive mechanism actuated by downward movement of the treadmills, or may be motor driven in a conventional manner by a common electric motor. In use, the operator walks upon the treadmills in a normal manner wherein the treadmills alternately move from the first position to the second position as the operator places weight on the respective treadmill, with the spring return hydraulic cylinder assemblies being operable for returning the treadmills from the second position to the first position when the operator's weight is removed from the treadmill.

16 Claims, 4 Drawing Sheets

TREADMILL APPARATUS WITH DUAL SPRING-LOADED TREADS

BACKGROUND AND SUMMARY OF THE INVENTION

The instant invention relates to exercise apparatus and more particularly to a treadmill having independent side-by-side treads which are individually spring-biased against downward movement during use to effectively provide the aerobic benefits of both walking and climbing.

Treadmill-type walking apparatus have heretofore been known in the art. In this connection, the U.S. Pat. to Speer, Sr. No. 4,204,673; Lee et al No. 4,938,473; and Trulaske No. 5,114,388 represent the closest prior art to the subject invention of which the applicant is aware. The patent to Speer Sr. discloses a treadmill having dual treads which are independently operated to provide a separate control of speed and/or resistance for each leg. The tread platforms are stationary and do not move relative to each other. The patent to Lee et al concerns a treadmill having a trampoline-like surface. The Lee treadmill includes a continuous tread which is supported at the peripheral edges by a plurality of springs. The spring-supported tread is resilient enough to absorb shock and rigid enough to provide a stable exercising surface. There are no rigid supporting surfaces beneath the tread. The Patent to Trulaske discloses a stair exerciser including pivotable stair platforms. The stair platforms reciprocate up and down as the user alternately steps up with each foot.

The instant invention provides a treadmill apparatus having dual treads which are spring biased against downward movement during use. Briefly, the treadmill comprises a frame, and two side-by-side independent treadmills each having a continuous tread and first and second ends. The first and second ends of the two treadmills are each pivotably supported on the frame by pivotable link members which are pivotably connected at a first end thereof to the frame and pivotably connected at a second end thereof to the treadmill body so as to maintain the tread in a generally horizontal disposition. Furthermore, the device includes spring-return hydraulic cylinders which are connected between the link assemblies and the frame. The springs of the cylinders are operable for resiliently supporting the treadmills in a first position above the frame, while the hydraulic portions of the cylinders resist downward movement of the treadmills when weight is placed thereon during walking. The springs of the cylinders are further operative for returning the treadmills to the first position when the weight is removed from the treadmill. The continuous treads may be driven by a mechanical drive means actuated by downward movement of the treadmills, or they may be driven by a motor, or motors, coupled to the respective roller shafts of the treadmills by a belt and pulley system. In use, the operator treads upon the two treadmills in a conventional manner wherein the treadmills alternately move downward and upward as an operator places weight on, and removes weight from each of the treadmills during walking.

Accordingly, among the objects of the instant invention are: the provision of an exercise device which offers the benefits of both walking and climbing; and the provision of a treadmill having dual independent treads which are individually spring-biased against downward movement.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
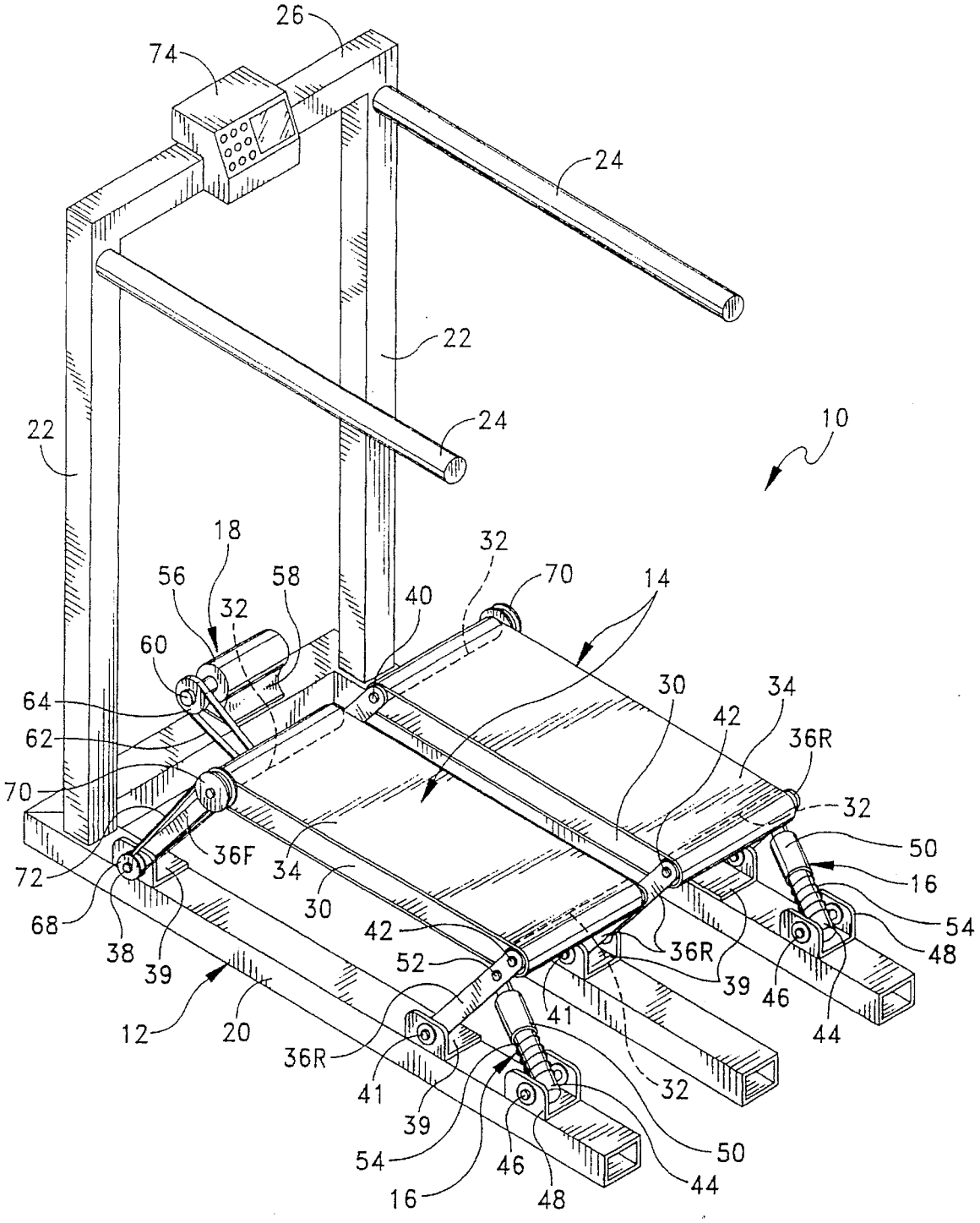
FIG. 1 is a perspective view of the instant treadmill apparatus.
Figure 2:
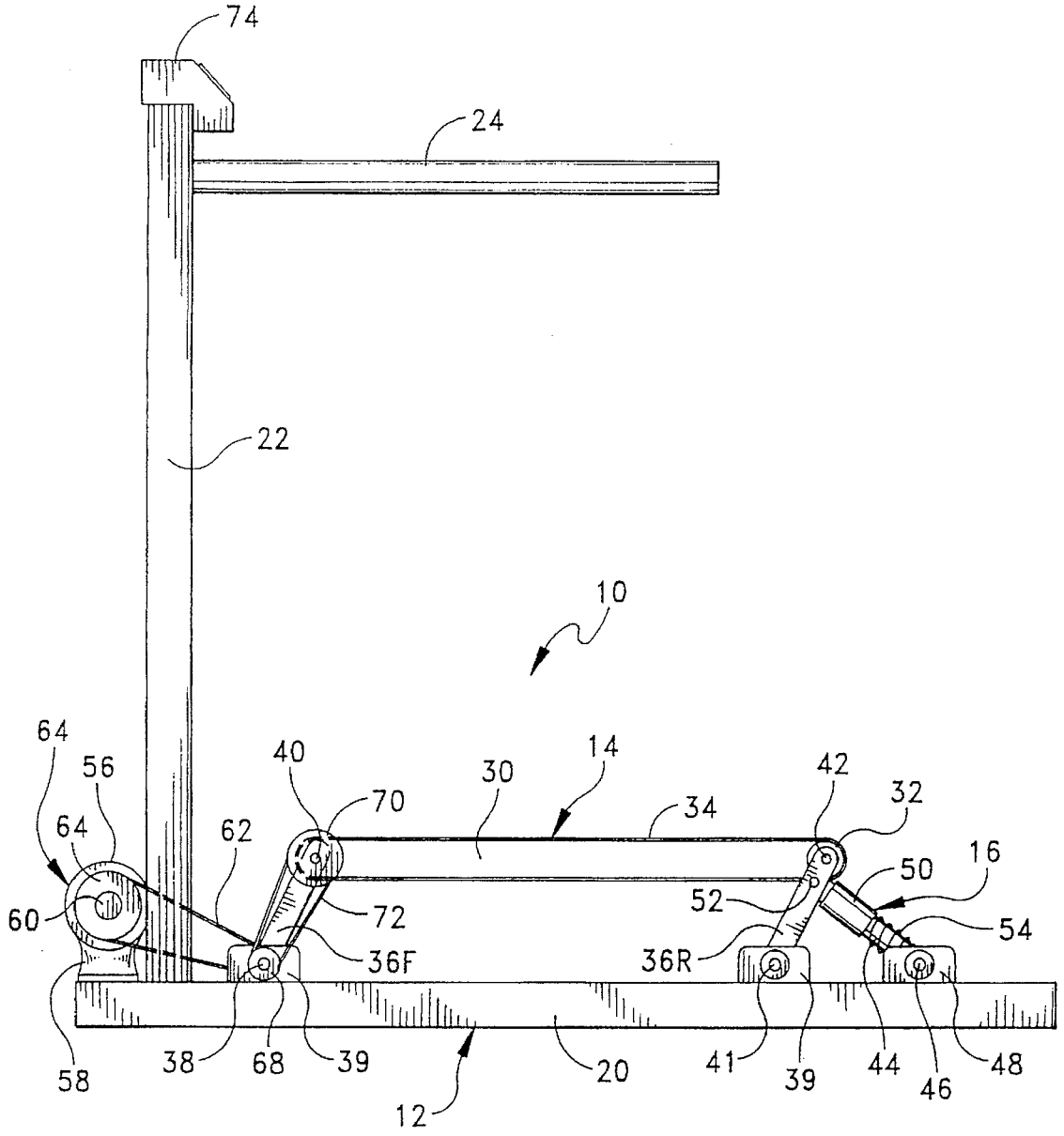
FIG. 2 is a side view thereof with the treadmills in the upper position.
Figure 3:
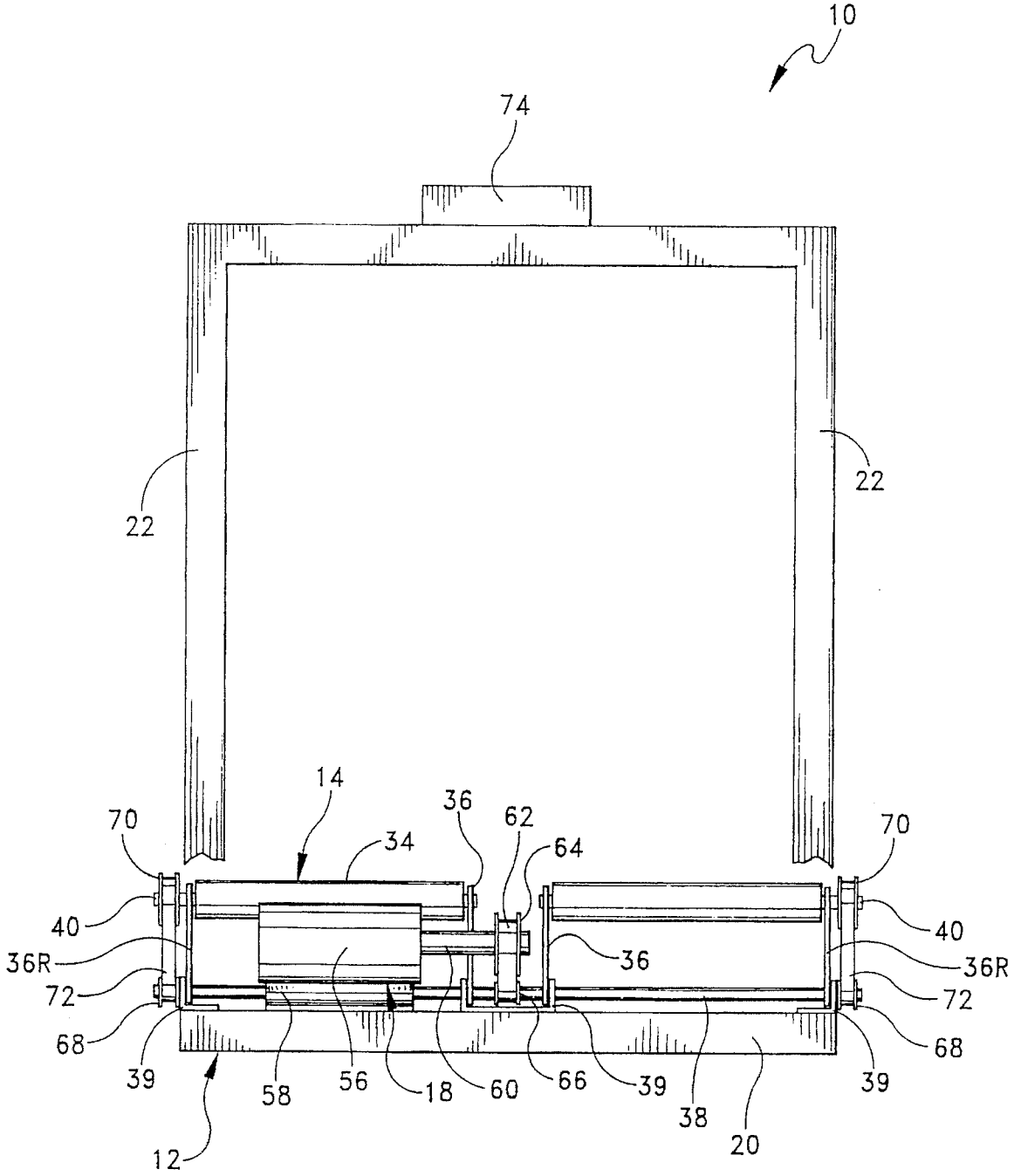
FIG. 3 is a front view thereof with portions of the frame broken away to illustrate the pulley and belt system for driving the continuous treads.

Referring now to the drawings, the treadmill device of the instant invention is illustrated and generally indicated at 10 in FIGS. 1–3. As will hereinafter be more fully described, the instant treadmill apparatus 10 includes dual side-by-side treads which function in tandem to simultaneously provide the benefits of both walking and climbing. The treadmill apparatus 10 comprises a frame generally indicated at 12, first and second side-by-side treadmills generally indicated at 14, first and second spring-return hydraulic cylinders generally indicated at 16, and a drive mechanism generally indicated at 18.

The frame 12 is preferably constructed from tubular steel, and it preferably comprises a rectangular base 20 and two spaced support members 22 which extend upwardly from a forward portion of the base 20. The support members 22 each include a handlebar 24 which extends rearwardly from the support member 22, and the frame further includes a cross bar 26 which extends between the upright support members 22.

The two treadmills 14 are identical in construction, and they each preferably comprise a rigid treadmill platform 30, rollers 32 (broken lines) rotatably mounted at each of the first and second ends of the platform 30, and a continuous tread 34 which extends around the platform 30 and is rotatably supported by the rollers 32. The construction of the treadmills 14 is considered to be conventional in the art, and therefore no further description is believed to be necessary. The treadmills 14 are pivotably supported on the frame 12 in side-by-side adjacent relation by means of pivotable front and rear link members 36F and 36R respectively positioned on each side of the treadmill 14 at respective ends of the treadmill 14. More specifically, a first end of each link member 36F is pivotably connected to the base 20 of the frame 12 by transmission rod 38 which extends across the width of the frame and through corresponding brackets 39, while the second end of each link member 36F is pivotably connected to the treadmill platform 30 by a pin 40. A first end of each link member 36R is pivotably connected to the base 20 by a pin 41 and bracket 39, while the second end of each link 36R is pivotably connected to the treadmill platform 30 by pin 42. Accordingly, it can be seen that a corresponding pair of link member 36 pivotably supports each end of each treadmill 14 above the frame 12. While the link members 36 have been illustrated as being the same length so as to support the treadmills in a generally horizontal position, it is contemplated that the link members 36 may be fashioned in different lengths to provide an inclined walking surface. For example, the forward link members 36F could be longer than the rear link members 36R to support the treadmills in a front to back inclined position such that the operator would feel as if they were walking uphill. Similarly, the rear link members 36R could be longer to simulate downhill walking. Furthermore, the link members 36 could be adjustable in length to provide a variety of different walking arrangement to suit the operator's particular exercise needs.

In this regard, the treadmills 14 are supported in a first position above the base 20 of the frame 12 by the spring-return hydraulic cylinders 16. The spring-return hydraulic cylinders 16 are conventional in the art, and they preferably each comprise a rod 44 which is pivotably connected by a pin 46 to a flange 48 on the base 20 of the frame 12, a body 50 which is pivotably connected by a pin 52 to the treadmill platform, and a coiled return spring 54. While the spring 54 is illustrated externally in the instant embodiment, it is to be understood that such cylinders may also have the spring located internally of the cylinder. The hydraulic cylinder 16 provides resistance against compression of the rod 50, and the return spring 54 operates to return the rod 50 to its original extended position after compression. In this connection, the coil spring 54 supports the treadmill 14 in a first normal elevated position (FIG. 2), while the hydraulic cylinder 16 resists downward movement of the treadmill 14 from the first position to a second position when an operator places weight thereon. The coil spring 54 then returns the treadmill 14 from the second position back to the first position when the operator removes his weight from the treadmill 14. The hydraulic cylinders 16 may each include an adjustment mechanism which is operative for adjusting the resistance of the hydraulic cylinder 16.

It is contemplated that the spring-return hydraulic cylinders 16 can be replaced by a torsion spring which is received around a pin of one of the link members 36. The torsion spring would be adjustable to provide variable resistance to downward movement of the treadmills 14. It is further contemplated that the return springs 54 of the hydraulic cylinders 16 could alternatively comprise external rubber bands which extend between the treadmills 14 and the support members 22. In this connection, the device would include a conventional hydraulic cylinders to resist downward movement of the treadmills 14 and rubber bands to return the treadmills 14 to their original position. It is pointed out that each of the spring return mechanisms must be strong enough to return the treadmills 14 to their original position before the operator again steps thereon, yet they should not be so strong as to immediately snap the treadmills 14 back into position. In this connection, the hydraulic cylinders 16 provide some resistance during the return of the treadmills 14 so that the upward and downward pivoting of the treadmills occurs in a smooth transition.

The drive mechanism 18 comprises an electric motor 56 which is mounted to the base 20 of the frame 12 by a bracket 58. The motor 56 includes a rotatable drive shaft 60 which is coupled to the rollers 32 by means of belt and pulley transmissions. In this regard, a first belt 62 extends around a pulley 64 on the drive shaft 60 and a pulley 66 on the transmission rod 38 extending across the width of the frame. Each outer end of the transmission rod 38 includes a further pulley 68, while the outer ends of the forward rollers 32 also include a pulley 70. Respective belts 72 extend around the corresponding pairs of pulleys 68, 70. In operation, rotation of the drive shaft 60 causes rotation of the rollers 32 and the continuous treads 34. Since both treadmills 14 are driven by a common transmission rod 38, the continuous treads 34 are driven at the same speed.

In operation, an operator stands with one leg positioned on each of the side-by-side treadmills 14, and then walks on the treadmills 14 at a pace equal to the speed of the continuous treads 34, i.e. in the same manner as a conventional treadmill. As the operator alternates steps and transfers weight back and forth between the two treadmills 14, the treadmills 14 alternately move down and up against the resistance of the hydraulic cylinders 16. More specifically, when the operator strides forward with one foot onto the respective treadmill 14, the treadmill 14 depresses downwardly against the resistance of the respective hydraulic cylinder 16. Referring to FIG. 3 it can be seen more clearly that the treadmills actually pivot rearwardly and downwardly about the link members 36 at both ends thereof. Thereafter, the rotating tread 34 moves the operator's foot rearwardly toward the rear end of the treadmill 14 until the operator strides forward with the opposite foot onto the opposite treadmill 14 wherein the second treadmill 14 moves downwardly and the first treadmill 14 is returned upwardly to its original position by the return spring 54. Accordingly, it can be seen that as a operator treads upon the treadmills 14, they alternately move up and down. It is noted that the treadmills do not pivot about an axis, but rather that they always remain in a generally horizontal disposition during upward and downward movement. Alternately, if the link members are of different sizes, the angle of inclination of the treadmills would remain relatively the same during downward movement. It is contemplated that the treadmills could be mechanically interconnected, thus requiring only on hydraulic cylinder for resistance.

The treadmill apparatus 10 is further provided with an electronic control and monitoring device 74 which is operative for controlling motor speed, and for measuring and displaying time, horizontal distance travelled, vertical distance travelled, calories burned, heart rate, and other exercise variables. The control device 74 is preferably mounted on the cross bar 26 so that it is readily accessible to the operator during operation of the treadmill 10.

Figure 4:
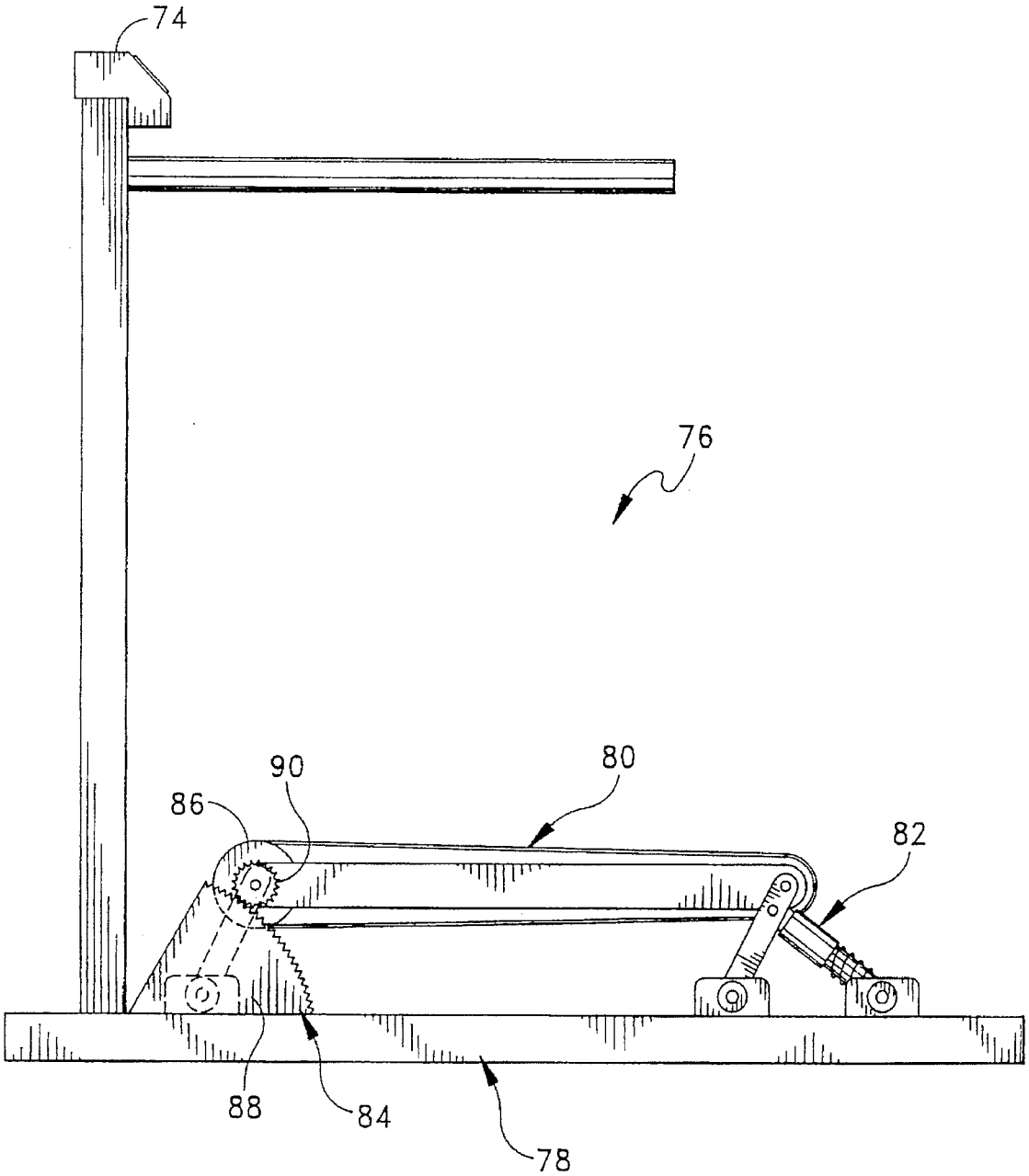
FIG. 4 is a perspective view of an alternative non-motorized embodiment incorporating a mechanical drive system.

Referring to FIG. 4 there is illustrated an alternative mechanically actuated embodiment generally indicated at 76. The device 76 is generally similar in construction to the first embodiment 10, and comprises a frame generally indicated at 78, first and second side-by-side treadmills generally indicated at 80, first and second spring-return hydraulic cylinders generally indicated at 82, and a mechanical drive mechanism generally indicated at 84.

The frame 78 is identical to the first embodiment 10, and thus will not be further described. Furthermore, the treadmills 80 are generally similar to treadmills 30 except that the forward rollers indicated here at 86 are enlarged. Still further, the link connections of the treadmills 80, as well as the hydraulic cylinder connections 82 are the same as previously described in the first embodiment 10. Movement of the treadmills 80 up and down is also the same.

The drive mechanism 84 comprises a pair of sector gears 88, one for each of the treadmills 80, mounted to the frame 78, and a corresponding gear 90 mounted on the forward roller shaft of each treadmill 80. In operation, downward movement of the treadmill 80 when stepped on causes the gear 90 to engage within the respective sector gear 88 and rotate, which in turn will cause rotation of the roller shaft and driving movement of the tread. The gear 90 is provided with a one-way clutch (not shown) so that the gear 90 is free to rotate when the treadmill 80 moves back upwardly and the gear 90 tracks backwardly along the sector gear 88. Accordingly, it can be seen that the weight of the operator is effective for causing downward movement of the treadmill and mechanical actuation of the tread. Although, the present sector gear arrangement is effective for non-motorized driving of the treads, other mechanical driving mechanisms are also possible.

It can therefore be seen that the instant invention provides an exercise device 10 which is effective for simultaneously providing the exercise benefits of both a conventional treadmill and a climbing apparatus. The treadmill apparatus 10 includes dual side-by-side treadmills 14 which operate in a conventional manner to simulate walking. In addition, the dual treadmills 14 move downward and upward as an operator treads thereon to simultaneously simulate upward climbing movement. The exercise device 10 is simple in design, and construction, and it is inexpensive to manufacture. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. Treadmill apparatus comprising:

first and second adjacent treadmills each having a continuous tread, and first and second ends, each of said treadmills including a rigid platform and rollers at each of said first and second ends for rotatably supporting said continuous tread on said rigid platform;

a frame positionable on a supporting surface;

first and second link means for respectively independently supporting the first and second ends of each of said first and second treadmills above said frame, each of said first and second link means having a first end pivotally connected to the frame and a second end pivotally connected to the rigid platform of each respective treadmill adjacent said respective end thereof;

first and second means for resiliently supporting the respective first and second treadmills in a first position above a supporting surface;

first and second resistance means for resisting downward movement of said first and second treadmills from said first position to a second position as weight is placed upon said treadmills, said first and second resilient supporting means returning said first and second treadmills from said second position to said first position when said weight is removed from said first and second treadmills, said first and second treadmills alternately moving up and down as an operator treads thereon; and drive means for respectively independently driving rotation of said continuous treads as said first and second treadmills are alternately reciprocated downward and upward during use.

2. In the treadmill apparatus of claim 1, said drive means comprising a motor having a rotatable drive shaft, a first transmission means for transmitting rotation of said motor drive shaft to one of said rollers of said first treadmill for independent rotation of said first tread and a second transmission means for transmitting rotation of said motor drive shaft to one of said rollers of second treadmill for independent rotation of said second tread.

3. In the treadmill apparatus of claim 2, said transmission means comprising a transmission rod, a first pulley on said drive shaft of said motor, a second pulley on said transmission rod, and a belt extended around said first and second pulleys, said transmission means further comprising a pulley adjacent each respective end of said transmission rod, a pulley attached to a respective of each of said treadmills, and respective belts which extend around said pulleys on said transmission rod and said pulleys on said rollers.

4. The treadmill apparatus of claim 2 further comprising control means for controlling operation of said motor.

5. The treadmill apparatus of claim 2 wherein said first and second resistance means comprises first and second hydraulic cylinders which are connected between said frame and a respective one of said first and second link means.

6. The treadmill apparatus of claim 2 wherein said first and second resilient supporting means and said first and second resistance means comprise respective first and second spring return hydraulic cylinders which are connected between said frame and said first and second treadmills and are operative for providing both resilient support and resistance.

7. The treadmill apparatus of claim 2 wherein said means for driving said treads comprises a mechanical drive mechanism actuated by downward movement of the treadmills.

8. The treadmill apparatus of claim 7 wherein said mechanical drive mechanism comprises a pair of sector gears each respectively mounted to said frame, and a corresponding spur gear mounted to a respective roller of each of said treadmills, said spur gear intermeshing with said sector gear during downward movement of said treadmill and thereby rotating said roller and tread during said downward movement.

9. Treadmill apparatus comprising:

first and second adjacent treadmills each having a continuous tread, and first and second ends, each of said treadmills including a rigid platform and rollers at each of said first and second ends for rotatably supporting said continuous tread on said rigid platform;

a frame positionable on a supporting surface;

means for respectively pivotally supporting the first and second ends of each of the first and second treadmills above said frame;

means for resiliently supporting the respective first and second treadmills in a first position above a supporting surface;

resistance means for independently resisting downward movement of said first and second treadmills from said first position to a second position as weight is placed upon said treadmills, said resilient supporting means returning said first and second treadmills from said second position to said first position when said weight is removed; and drive means for respectively independently driving rotation of said continuous treads as said first and second treadmills are alternately reciprocated downward and upward during use.

10. In the treadmill apparatus of claim 9, said drive means comprising a motor having a rotatable drive shaft, a first transmission means for transmitting rotation of said motor drive shaft to one of said rollers of said first treadmill for independent rotation of said first tread and a second transmission means for transmitting rotation of said motor drive shaft to one of said rollers of second treadmill for independent rotation of said second tread.

11. In the treadmill apparatus of claim 10, said transmission means comprising a transmission rod, a first pulley on said drive shaft of said motor, a second pulley on said transmission rod, and a belt extended around said first and second pulleys, said transmission means further comprising a pulley adjacent each respective end of said transmission rod, a pulley attached to a respective of each of said treadmills, and respective belts which extend around said pulleys on said transmission rod and said pulleys on said rollers.

12. The treadmill apparatus of claim 10 further comprising control means for controlling operation of said motor.

13. The treadmill apparatus of claim 10 wherein said first and second resistance means comprises first and second hydraulic cylinders which are connected between said frame and a respective one of said first and second link means.

14. The treadmill apparatus of claim 10 wherein said first and second resilient supporting means and said first and second resistance means comprise respective first and second spring return hydraulic cylinders which are connected between said frame and said first and second treadmills and are operative for providing both resilient support and resistance.

15. The treadmill apparatus of claim 10 wherein said means for driving said treads comprises a mechanical drive mechanism actuated by downward movement of the treadmills.

16. The treadmill apparatus of claim 15 wherein said mechanical drive mechanism comprises a pair of sector gears each respectively mounted to said frame, and a corresponding spur gear mounted to a respective roller of each of said treadmills, said spur gear intermeshing with said sector gear during downward movement of said treadmill and thereby rotating said roller and tread during said downward movement.

* * * * *